US010960430B2

(12) United States Patent
Fee et al.

(10) Patent No.: US 10,960,430 B2
(45) **Date of Patent: *Mar. 30, 2021**

(54) PAINT EDGING SYSTEM AND APPARATUS

(71) Applicant: NOVA WILDCAT SHUR-LINE, LLC., Mooresville, NC (US)

(72) Inventors: Garry C. Fee, Huntersville, NC (US); John C. Morphey, Concord, NC (US)

(73) Assignee: NOVA WILDCAT SHUR-LINE, LLC., Mooresville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/019,401

(22) Filed: Jun. 26, 2018

(65) Prior Publication Data

US 2018/0304298 A1 Oct. 25, 2018

Related U.S. Application Data

(62) Division of application No. 14/800,326, filed on Jul. 15, 2015, now Pat. No. 10,040,093.

(60) Provisional application No. 62/024,824, filed on Jul. 15, 2014.

(51) Int. Cl.
*B05C 17/00* (2006.01)
*B05C 17/005* (2006.01)

(52) U.S. Cl.
CPC ..... *B05C 17/00* (2013.01); *B05C 17/00589* (2013.01)

(58) Field of Classification Search
CPC ..... B05C 17/0242; B05C 17/00589; B05C 17/00
USPC ..... 401/193; 118/505
See application file for complete search history.

(56) References Cited

U.S. PATENT DOCUMENTS

| | | | | |
|---|---|---|---|---|
| 3,629,894 | A * | 12/1971 | Stefany | B05C 17/00 15/146 |
| 3,918,820 | A | 11/1975 | Kim | |
| 4,424,603 | A | 1/1984 | Balint et al. | |
| 5,134,745 | A | 8/1992 | Burns et al. | |
| 5,209,781 | A | 5/1993 | Milkie | |
| 5,495,635 | A | 3/1996 | Williams | |
| 6,305,043 | B1 | 10/2001 | Rosnak | |
| 8,032,973 | B2 | 10/2011 | Lutgen et al. | |
| 8,480,325 | B2 * | 7/2013 | Gallardo | A46B 5/02 15/114 |

* cited by examiner

*Primary Examiner* — David J Walczak
(74) *Attorney, Agent, or Firm* — McGuireWoods LLP

(57) ABSTRACT

A paint edging tool that deliver paint with sharp, clear edges at wall junctions. The paint edging tool includes a base wherein the base may include a handle, at least one wheel, a painting pad, a built-in-deflector, and at least one pad ejector. The handle may be configured to allow rotation between multiple positions. The handle may further include an adapter wherein the adapter is configured to be mounted on the handle, thereby allowing a pivoting motion in relation to the wall. The base may include at least one lobe, wherein the lobe is configured to be located on each side of the base, and is further configured to connect with the at least one wheel. The painting pad may be configured to be notched around the at least one deflector and the at least one wheel in order to allow painting inside a corner area of a wall.

12 Claims, 13 Drawing Sheets

PAINT EDGING SYSTEM AND APPARATUS

CROSS-REFERENCE TO RELATED APPLICATIONS

This application is a divisional of U.S. Non-Provisional patent application Ser. No. 14/800,326, filed Jul. 15, 2015, which claims benefit and priority to U.S. Provisional Application No. 62/024,824, filed on Jul. 15, 2014, titled "PAINT EDGING SYSTEM AND APPARATUS," the disclosures of which are incorporated herein in their entirety.

FIELD OF THE DISCLOSURE

This disclosure is directed generally to devices for applying a liquid, and more particularly to applying paint to edging.

BACKGROUND OF THE DISCLOSURE

When painting a room, a painter typically first "edges" the room by carefully applying paint around the room edges or trim elements (e.g., doors, windows, floors, cabinets, ceilings, crown molding, etc.) where the paint is not be applied, or by applying tape or other covering over those portions of the room. The painter then fills in the remaining portions of the wall. Tools for edging and/or painting the room include typical paint brushes or rollers than can be dipped into a paint can or tray.

U.S. Pat. No. 8,032,973 to Joseph Lutgen discloses a device for applying liquids to substrates and, more specifically, a device for applying paint.

There remains an unmet need for a painting system that provides end users with the tools needed to efficiently edge a room.

SUMMARY OF THE DISCLOSURE

According to aspects of the disclosure, a paint edging system and apparatus are described herein that deliver paint with sharp, clear edges at wall junctions with ceilings, other walls, trim, edge boards, and the like. In an aspect of the present disclosure, an edging tool for applying a liquid to a wall is provided. The edging tool includes a base; a painting pad that is adjacent and parallel to the base; a handle disposed on the base; and at least one wheel attached along an edge of the base.

The handle may be configured to allow rotation between multiple positions as to allow the edging tool move in a flexible manner. The handle may be statically molded to the base. The handle may include an adapter, wherein the adapter may be configured to be mounted on the handle, thereby allowing a pivoting motion in relation to the wall. The base may further include at least one lobe, wherein the at least one lobe may be configured to be located on each side of the base, and is further configured to connect with the at least ogre wheel. The at least one wheel may be configured to be located near a front edge of the base, and is further configured to guide the edging tool along the wall.

The painting pad may be configured to be placed on an underside of the base. The painting pad may include at least one hole on a bottom of the painting pad as to allow the liquid through.

The base may further include at least one built-in-deflector, wherein the at least one built-in-deflector may be configured to be angled away from the wall. The at least one built-in-deflector wherein the at least one built-in-deflector is statically molded to the base.

The painting pad may be configured to be notched around the at least one deflector and the at least one wheel in order to allow painting inside a corner area of the wall.

The base may further include filaments, wherein the filaments with light pressure, assist the painting pad with painting.

The base may further include a paint ejector; and a rotation stop, wherein the paint ejector is configured to remove the painting pad from the base, and wherein the rotation stop is configured to prevent the pad ejector from rotating beyond an angle that could result in the pad ejector from being trapped below the painting pad.

The liquid may include a paint; a lacquer; a sealer; an ink; a varnish; a stain; or a dye.

In another aspect of the present disclosure, an edging tool for applying a liquid to a wall includes a base; a reservoir disposed on the base, a handle disposed on the base, at least one wheel attached along an edge of the base, and a painting pad adjacent and parallel to the base.

The reservoir may be configured to hold the liquid. The reservoir may further include an opening, wherein the opening is configured to naturally seal with a mating attachment of the base, as to allow the liquid to be dispensed from the reservoir to the base and the painting pad, wherein the painting pad comprises at least one hole on a bottom of the painting pad to allow the liquid through.

The reservoir may further include at least one of a transparent ethylene vinyl acetate (EVA); or thermoplastic material suitable to provide squeezing capability with adequate rebounding characteristics to prevent permanent deformation of the reservoir.

The base may further include at least one deflector, and wherein the painting pad is configured to be notched around the at least one deflector and the at least one wheel in order to allow painting inside a corner area of the wall.

The base may further include a paint-on-board joint, wherein the paint-on-board joint is configured to rotate around an axis perpendicular to the base.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

Figure 1:
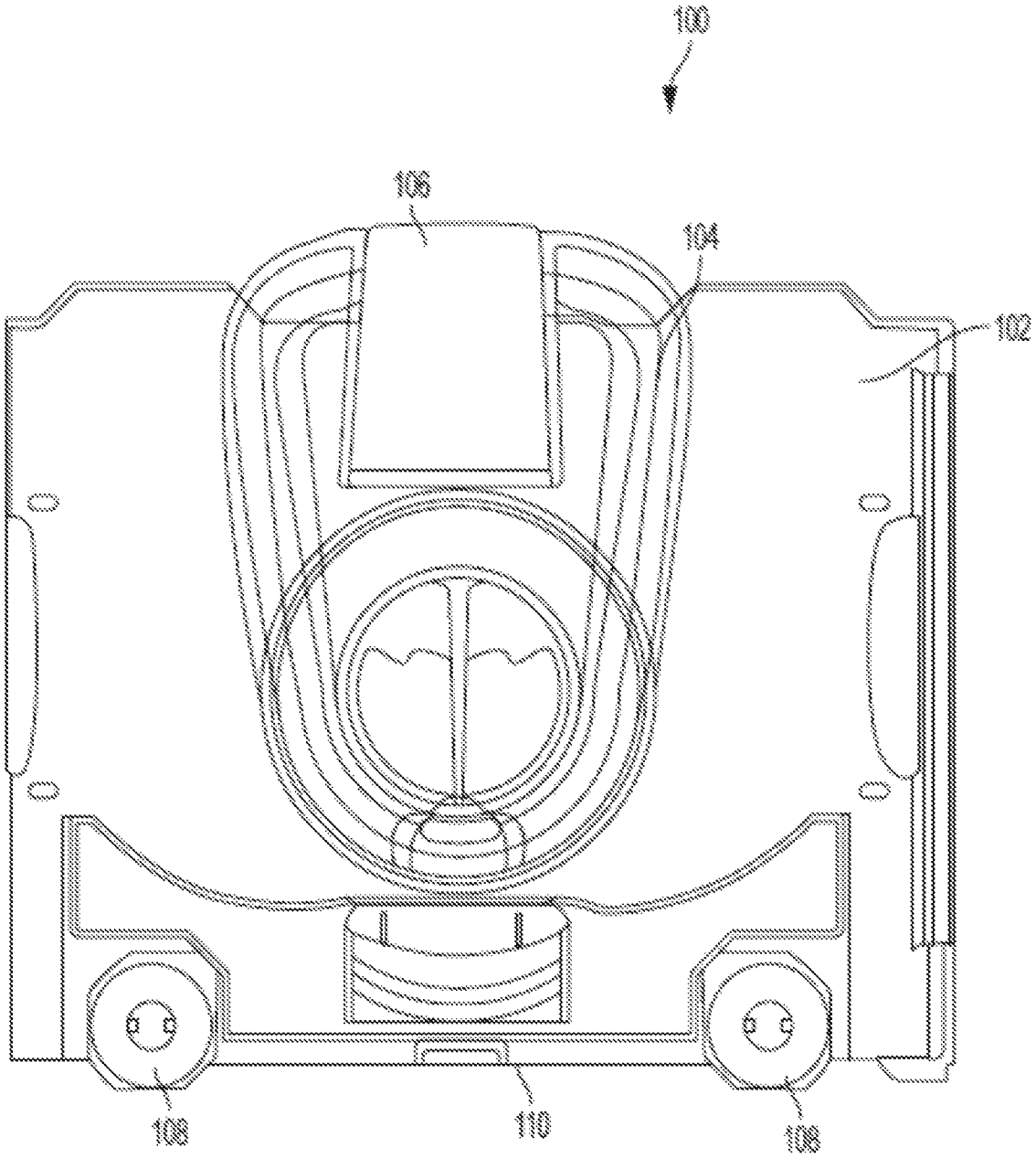
FIG. 1 shows a top view of an example of an edging tool that is constructed in accordance with the present disclosure.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Although process steps, method steps, or the like, may be described in a sequential order, such processes and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

FIG. 1 illustrates one example of an edging tool 100 particularly suited for painting borders. In the painting arena, borders are typically painted around windows, doorways, adjacent walls, etc. before the larger, remaining surfaces are painted. The edging tool 100 may be used to apply other liquids to surfaces, s as, e.g., sealants, lacquers, varnishes, stains, and the like.

Figure 2:
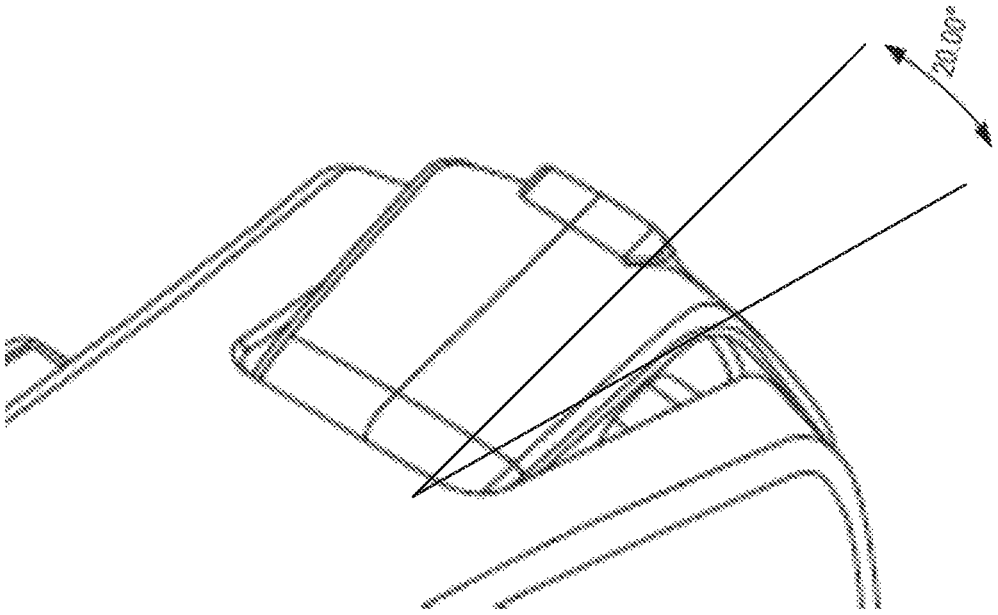
FIG. 2 shows a close-up of side perspective view of a handle of the edging tool shown in FIG. 1.

The edging tool 100 includes a base 102, wherein the base may include a handle 104. The handle 104 may be mounted on the base 102. In accordance with an aspect of the present disclosure, the handle 104 may be configured to allow rotation between multiple positions two positions), as shown in FIG. 1. For example, the handle 104 may be configured to pivot 20 degrees to each side from a center position. A handle-to-base interface may include a spring return device, such as an injection molded plastic device, that slips over threads of the interface and causes the handle 104 to return to its default center position after being twisted and released. In accordance with other aspects of the disclosure, the handle 104 may be statically molded to the base 102. The handle 104 may further include an adapter 106 which may be mounted on the handle 104, allowing a pivoting motion in relation to the wall being painted (as shown in e.g., FIG. 2). The adapter 106 may be configured to connect to an external pole (not shown), which may be used when painting difficult to reach surfaces. The adaptor 106 may include threads for engaging corresponding threads on the external pole.

The base 102 may further include at least one wheel 108. The at least one wheel 108 may be provided near a front edge of base 102. The at least one wheel 108 may be configured to guide the edging tool 100 along e.g., a surface to be painted. For example, when painting an upper edge of a wall, the at least one wheel 108 may be configured to engage a ceiling.

The base 102 may also include at least one painting pad 110. The at least one painting pad 110 may be configured to be placed on an underside of the base 102. The painting pad 110 may be used to apply paint to a surface of e.g., a wall, a ceiling, or the like.

Figure 3:
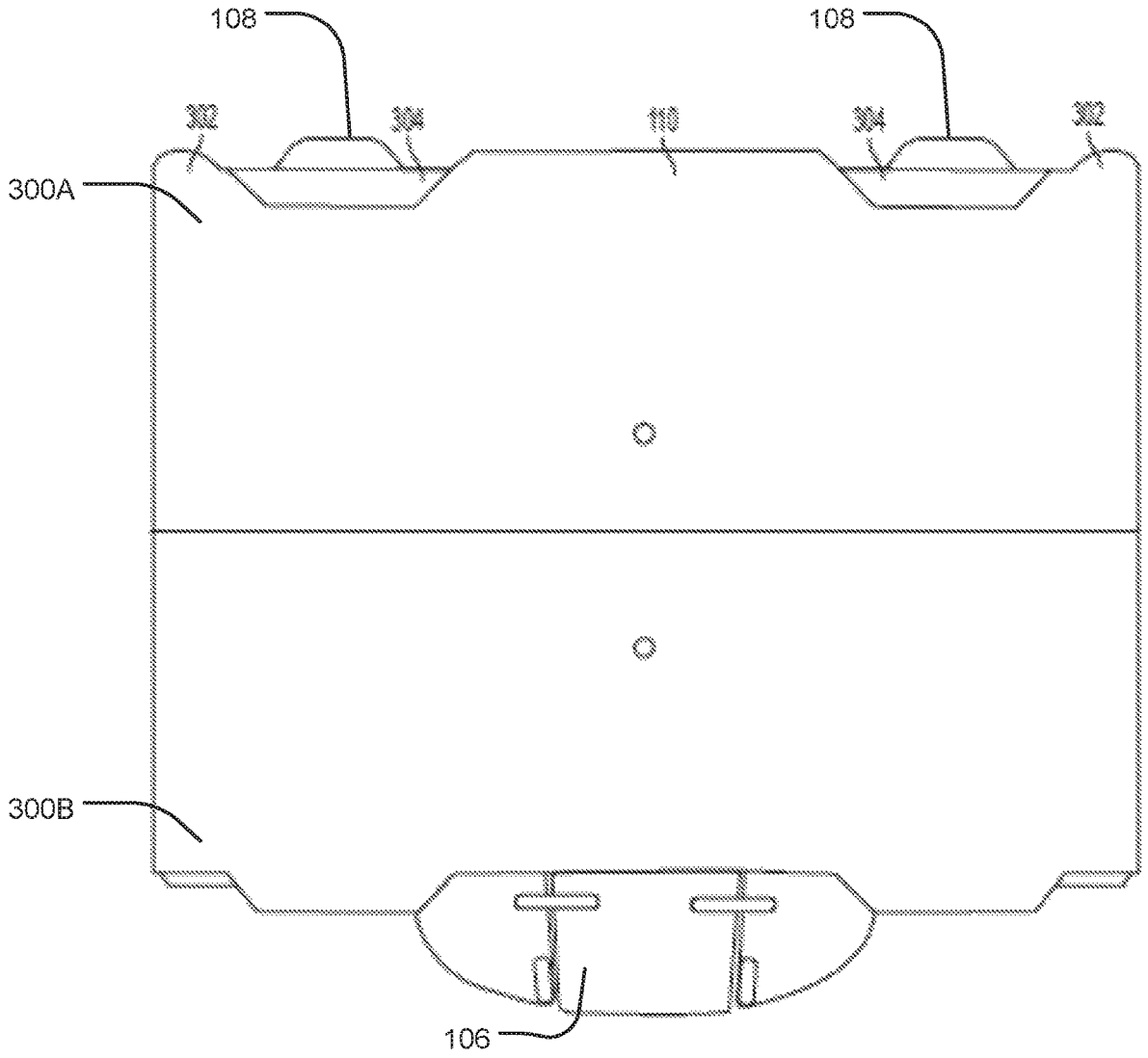
FIG. 3 shows a bottom view of an example of a liquid pad that is constructed in accordance with the present disclosure.

As shown in FIG. 3, the painting pad 110 may be designed to keep paint away from the at least one wheel 108, keeping the at least one wheel 108 free and preventing unintentional wall marking. Front corners 302 may be designed to allow painting inside corner areas to minimize fine touch up areas. The painting pad 110 may be profiled, as shown at 304, to keep deflectors and wheels away from the wet edges of the painting pad 110.

The painting pad 110 may include a flat edge on opposing sides of the painting pad 110. In further embodiment of the present disclosure, the painting pad 110 may be cut by a single profiled blade so that opposite sides of the painting pad 110 (as shown in, e.g., 300A and 300B) has an opposite handed profile extension in a negative image of a notch. This will assist with reducing waste and removing secondary production processes.

Figure 4A:
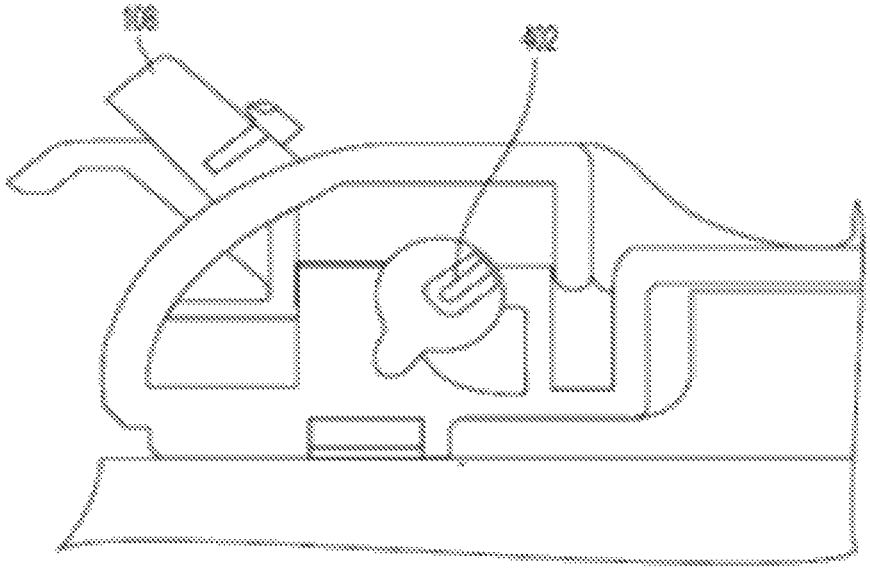
FIG. 4A shows a side cutaway view of an example of the edging tool with its wheels lifted that is constructed in accordance with the present disclosure.

Referring to 1, and 4A-4B concurrently, the at least one wheel 108 may be rotatable. The base 102 may include at least one lobe 402. The at least one lobe 402 may be located on the base 102 on each side of the base 102 connect with at least one wheel 108 to the base 102. Rotating the at least one lobe 402 may cause the at least one wheel 108 to retract, for example, up to approximately 45 degrees (as shown in, e.g., FIG. 4A). In another embodiment of the present disclosure, rotating the at least one lobe 402 may cause the at least one wheel 108 to retract greater than approximately 45 degrees.

Figure 4B:
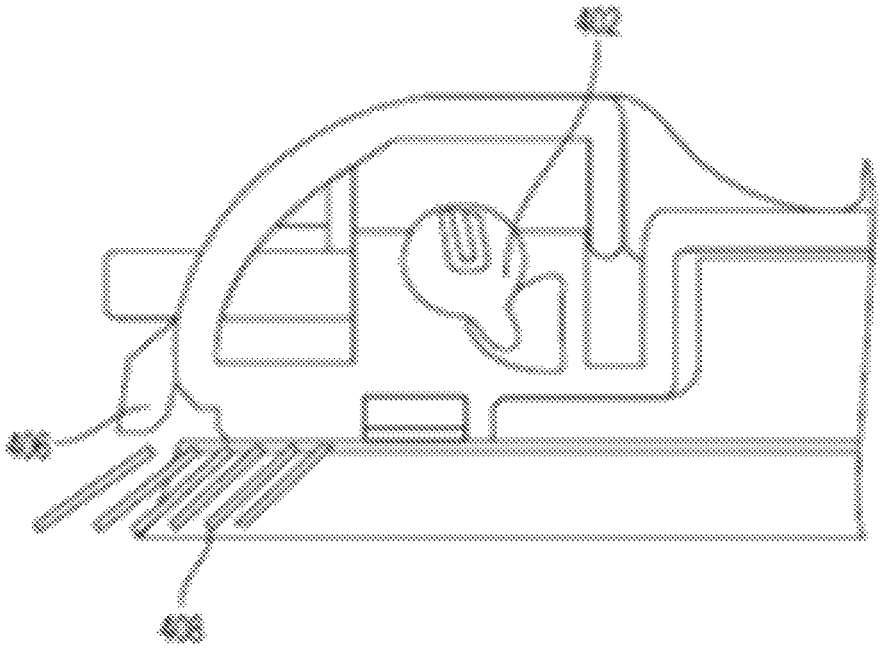
FIG. 4B shows a side cutaway view of an example of the edging tool with its wheels lowered that is constructed in accordance with the present disclosure.

In an embodiment of the present disclosure, the at least one lobe 402 may be configured to act as e.g., detent to hold the at least one wheel 108 in position and stop the at least one wheel 108 from e.g., flapping, when in lifted or lowered position (as shown in FIG. 4B).

The base 102 may further include at least one built-in deflector 406. The at least one built-in-deflector 406 may be angled away from e.g., ceilings, other walls, trim, edge boards, and the like, keeping a wet edge of the painting pad 110 away from low level trim pieces when the rolling wheels are too high to function.

In an embodiment of the present disclosure, the at least one deflector 406 may be moveable.

In yet another embodiment of the present disclosure, the at least one deflector 406 may be statically molded to the body of the base 102.

In further embodiment of the present disclosure, the painting pad may be configured to be notched around the at least one deflector and the at least one wheel in order to allow painting inside a corner area of the wall.

As shown in FIG. 4, the base 102 may further include filaments 408. The filaments 408 may be configured to be part of the painting pad 110. The filaments 408, with light pressure, crush and slant the edging tool forward to paint all the way to e.g., ceilings, other walls, trim, edge boards, and the like.

Figure 5:
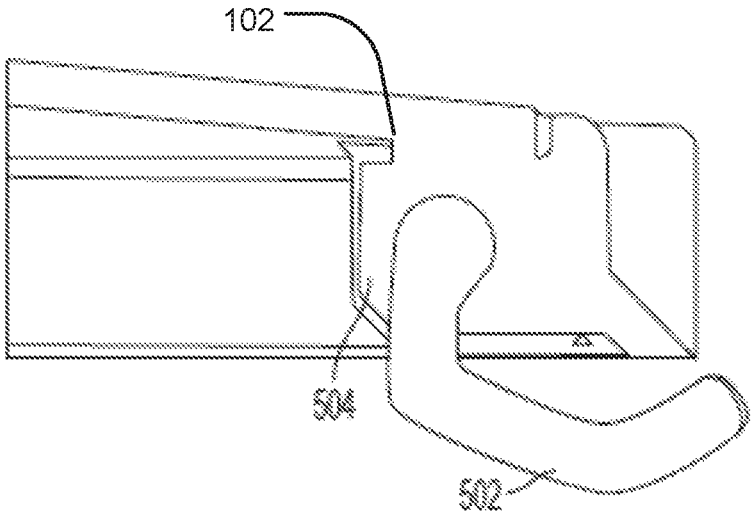
FIG. 5 shows an example: of a pad ejector forming part of the edging tool that is constructed in accordance with the present disclosure.

Referring to FIGS. 1, 3, and 5 concurrently, the base 102 may further include a pad ejector 502. The pad ejector 502 may be configured to remove the painting pad 110 from base 102. The pad ejector 502 may flip down to eject the painting pad 110.

In an embodiment of the present disclosure, a single pad ejector may be provided or one or more pad ejectors may be provided on one or more sides of base 102.

The base 102 may further include a rotation stop 504. The rotation stop 504 may be configured to prevent the pad ejector 502 from rotating beyond an angle that could result in the ejector being trapped below the pad. While the device shown in FIG. 5 includes a paint ejector 502, in accordance with some aspects of the disclosure, the paint ejector 502 may be omitted. On models where a paint ejector is not provided, a large, low level area may be provided in order to facilitate manual ejection of the pad (as shown in, e.g., FIG. 8).

Figure 6:
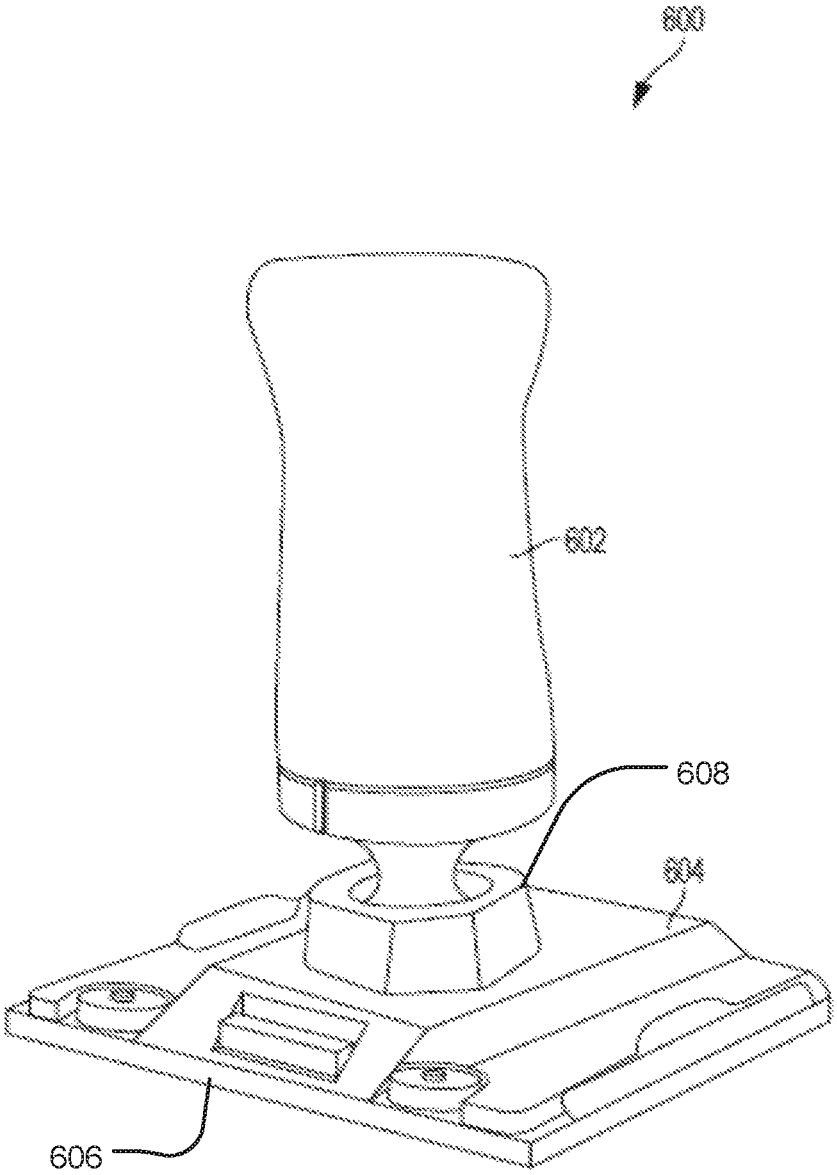
FIG. 6 shows another example of an edging tool that is constructed in accordance with the present disclosure.

FIG. 6 shows another example of an edging tool that is constructed in accordance with the present disclosure. As shown in FIG. 6, an edging tool 600 may be configured as a paint-on-board system. The edging tool 600 includes a reservoir 602 and a base 604. The reservoir 602 may be configured to hold a liquid, such as, for example, a paint, a lacquer, a sealer, an ink, a varnish, a stain, a dye, and the like. The base may include a painting pad 606 for dispensing the paint onto e.g., a wall.

Figure 7:
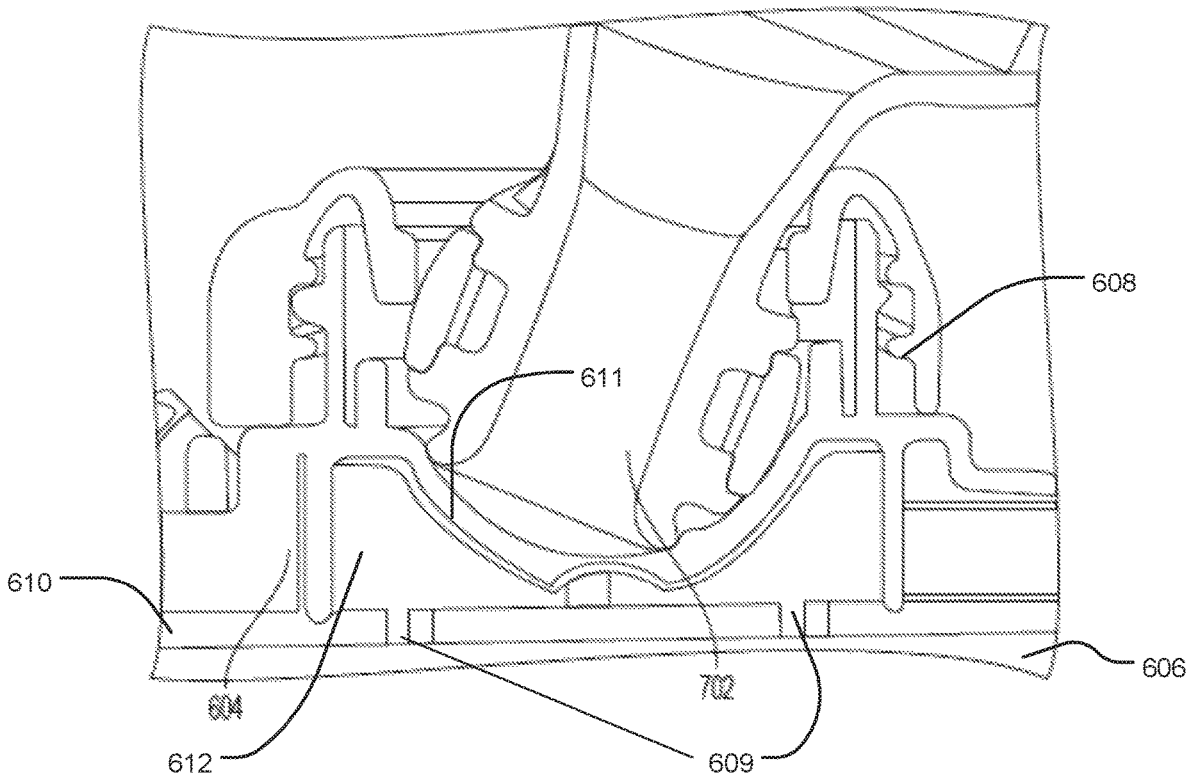
FIG. 7 shows a close up cutaway view of an aspect of the edging tool shown in FIG. 6.

Referring to FIGS. 6-7 concurrently, the reservoir 602 may be connected to the base 604 to dispense paint from the reservoir 602 without dipping the painting pad 606 into e.g., a paint tray to load it with paint. The reservoir 602 eliminates potential drips and spills when reloading the roller. The paint reservoir 602 may be a squeezable reservoir. The squeezing action may activate release of paint from the reservoir and onto the painting pad 606. The painting pad 606 may include at least one hole 609 and a gasket arrangement 610 in order to allow the paint to be transferred from reservoir 602 to base 604, through a hole or holes 611 in the base 604, into a reservoir 612 and then through the at least one hole 609 and gasket 610, both in the painting pad 606, to a painting surface of the painting pad 606. The reservoir 602 may be formed of a transparent ethylene vinyl acetate (EVA) or thermoplastic material suitable to provide squeezing capability with adequate rebounding characteristics to prevent permanent deformation of the reservoir. A defined squeezing area, for example, away from the opening of the reservoir may be provided.

The paint reservoir 602 may include an opening (not shown) which may be configured to naturally seal with a attachment 608 of base 604 via e an O-ring (not shown) or the like. The paint reservoir 602 may be of a capacity that makes painting for a longer time that is typically when using a paint tray to be accomplished. For example, the paint reservoir 602 may hold enough paint to cover all edges of two standard size windows and two standard size doors, to sufficiently trim a full room, or to paint a full sheet of drywall (e.g., a 4'×8' area). The base 604 may be configured in a manner similar to base 102 described above.

A paint-on-board joint 702 may be formed into base 604. The paint-on-board joint 702 may be configured to rotate around an axis perpendicular to the plane of the base 604 and/or pivot with respect to the perpendicular axis, as seen in FIG. 7 (e.g., forward and back), for example, about 20 degrees in each direction.

Figure 8:
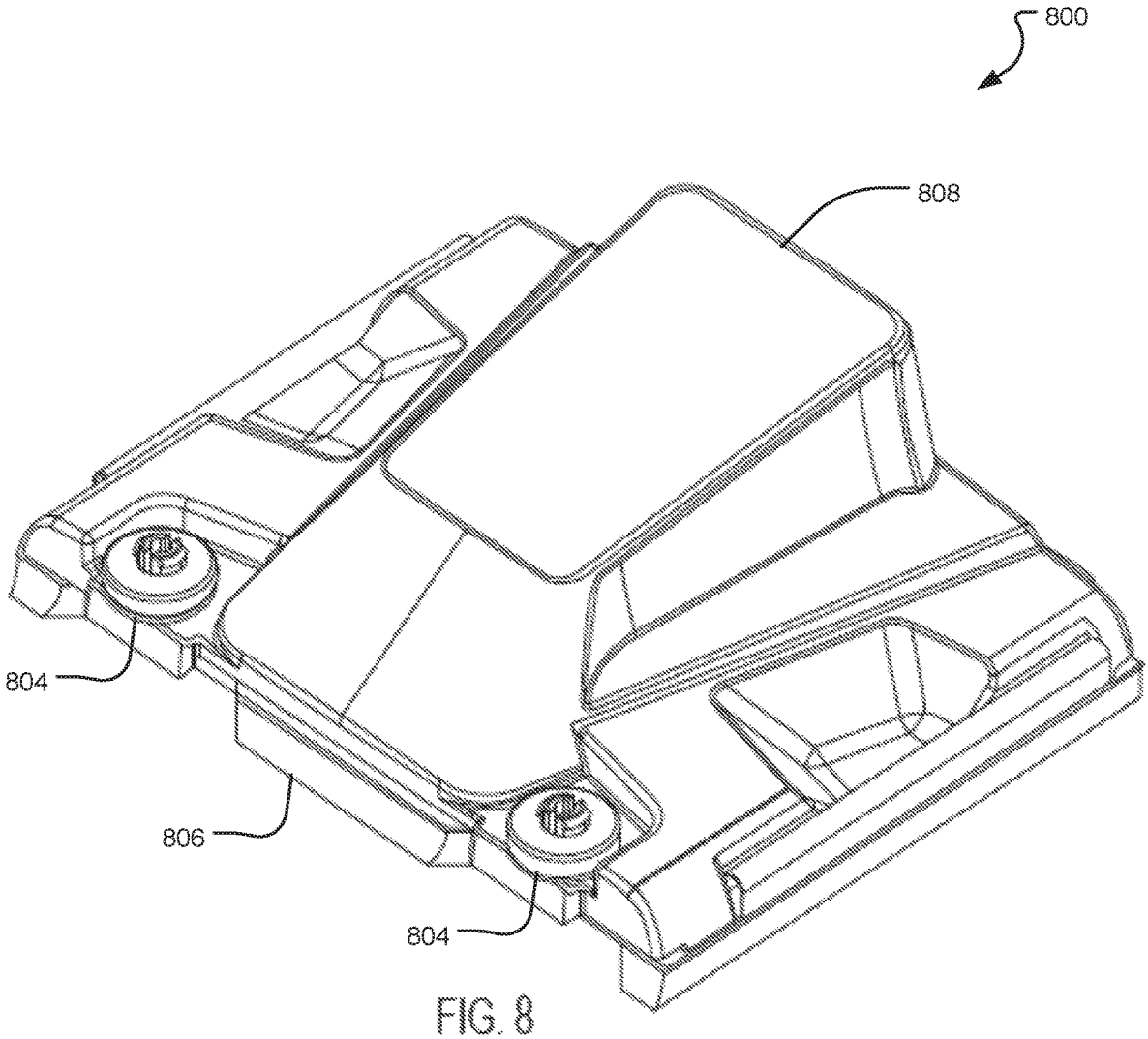
FIG. 8 shows a side perspective view of yet another example of an edging tool that is constructed in accordance with the present disclosure.
Figure 9:
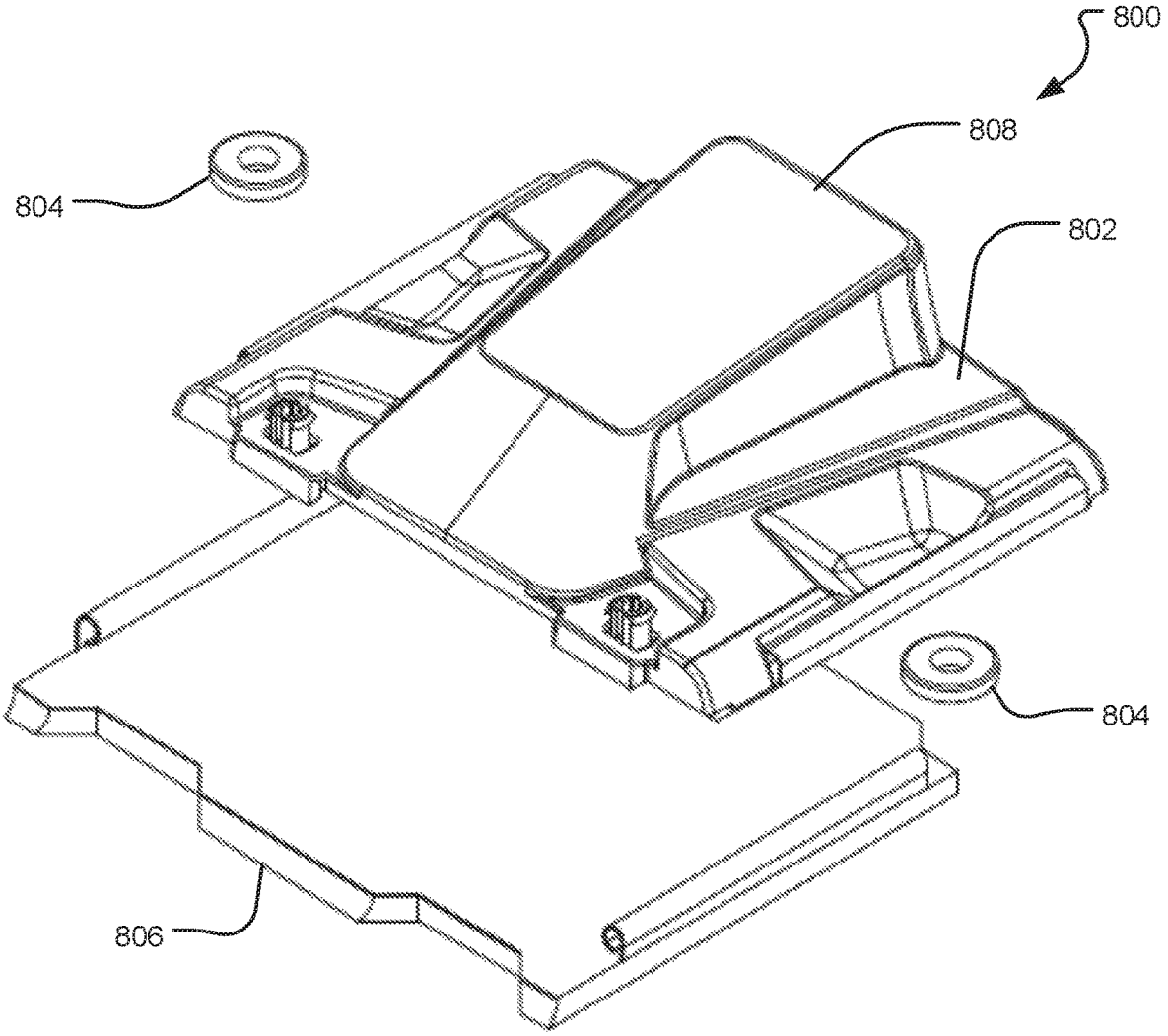
FIG. 9 shows an exploded view of an edging tool shown in FIG. 8.

FIGS. 8-9 show yet another example of an edging tool 800 that is constructed in accordance with the present disclosure. The edging tool 800 includes a base 802. The base 802 may include a cover element 808, at least one wheel 804, and a painting pad 806.

Figure 10:
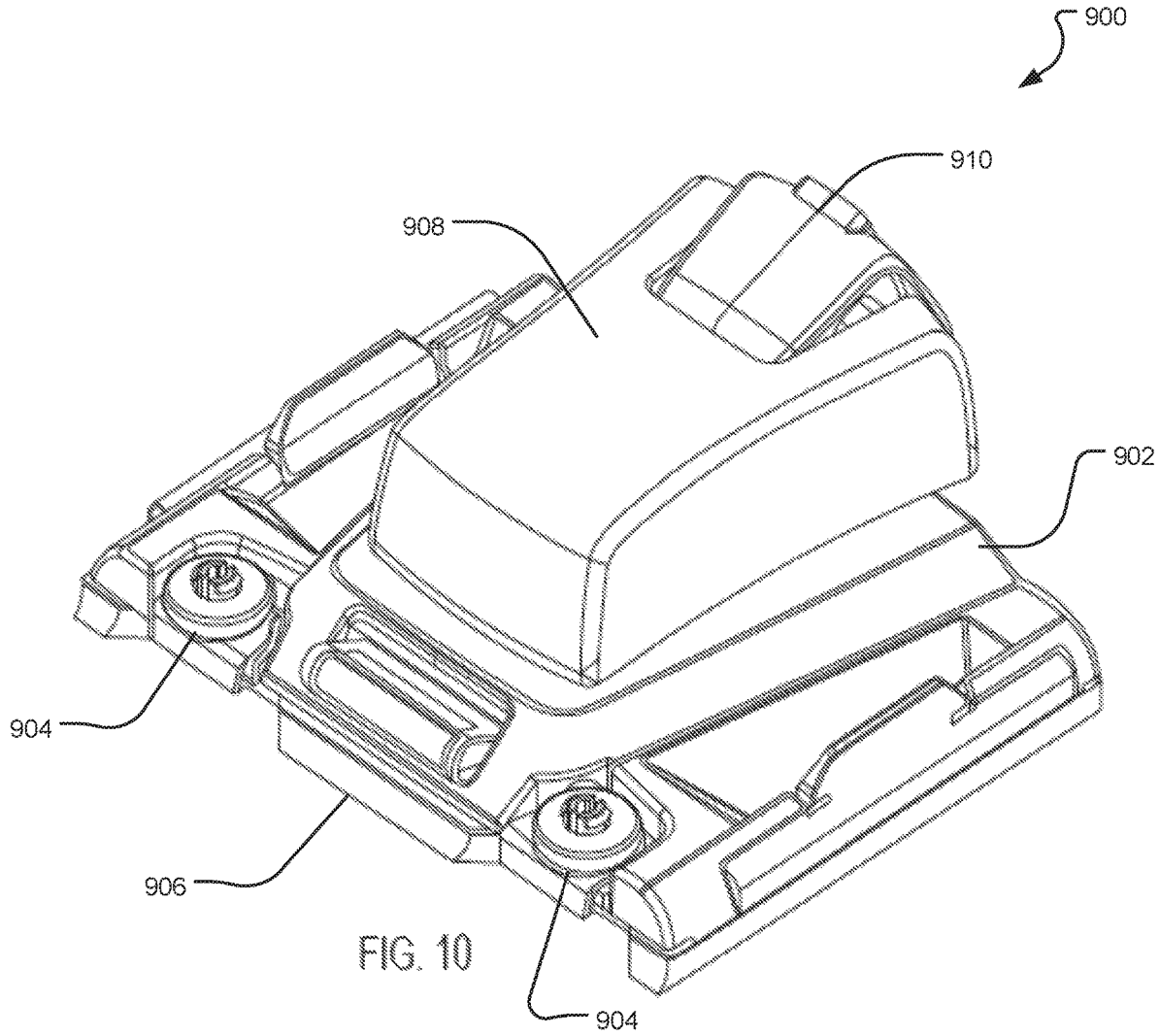
FIG. 10 shows a side perspective view of yet another example of an edging tool that is constructed in accordance with the present disclosure.
Figure 11:
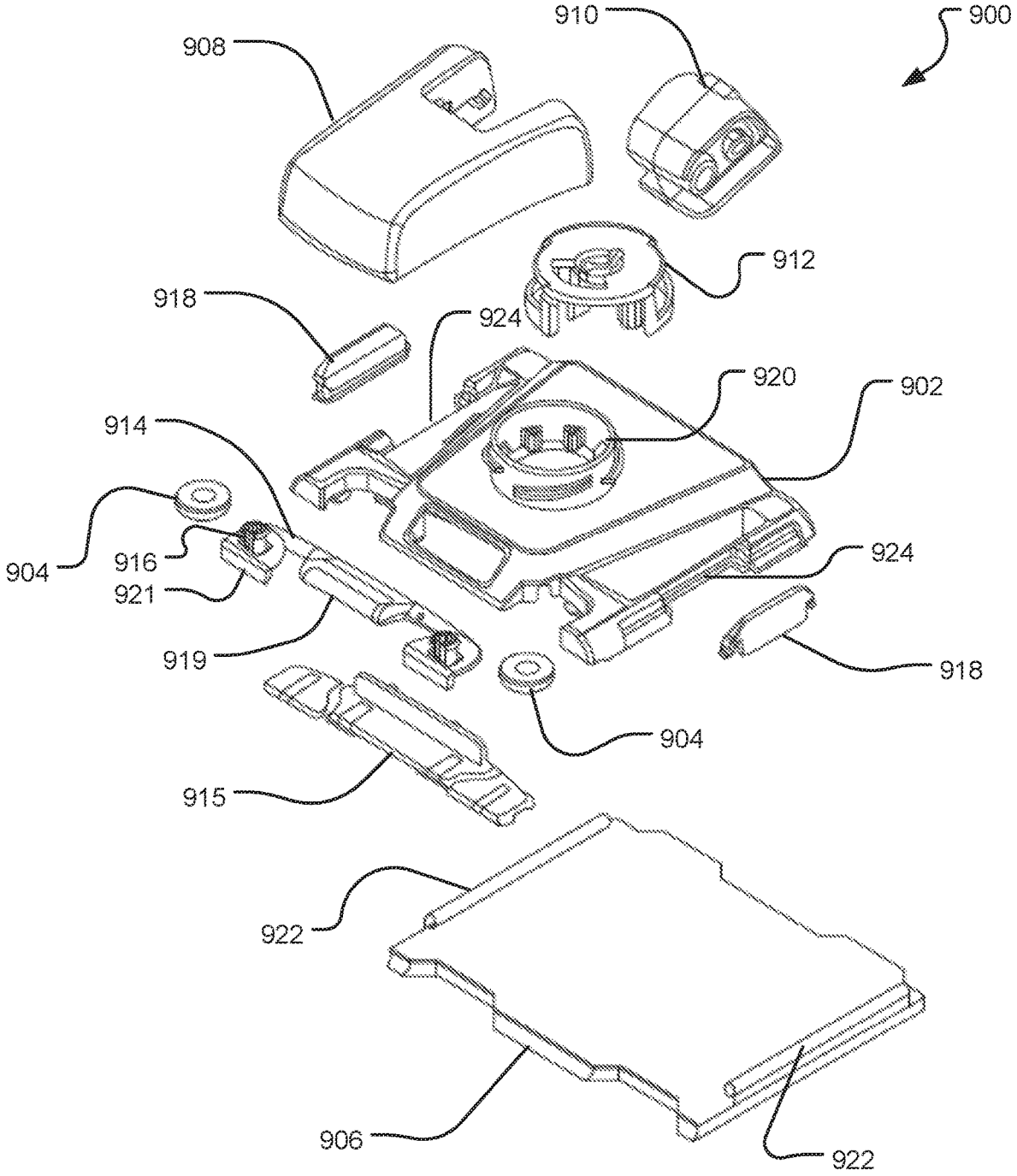
FIG. 11 shows an exploded view of an edging tool shown in FIG. 10.

FIGS. 10-11 show yet another example of an edging tool 900 that is constructed in accordance with the present disclosure. The edging tool 900 includes a base 902, a cover element 908, at least one wheel 904, and a painting pad 906.

The cover element 908 may further include a connector element 910. The connector element 910 may be configured to connect to e.g., a threaded pole (not shown) on e.g., an extension pole that a consumer may use, and the like.

The cover element 908 may further include the base connector 912 which may be configured to be stored inside the cover element 908 The base connector 912 may be configured as an adapter piece to secure the attachment of the cover element 908 to the base 902 via a threaded adapter 920. Additionally, the base connector 912 may removably connect with the base 902 via e.g., fastening mechanism, a clap-on mechanism, an adhesive, and the like, by connecting with the threaded adapter 920. The threaded adapter 920 may be formed on a surface of the base 902 (via e.g., molding) facing the cover element 908 and may include at least one thread to connect with the base connector 912. The threaded adapter 920 may further include at least one connecting rod to fit into e.g., a corresponding hole, on the base connector 912.

The base 902 may further include a first front attachment 914 which may include at least one rod 916 to connect with at least one wheel 904. The at least one rod 916 and the at least one wheel 904 may be connected by fastening mechanism or an adhesive.

The base 902 may further include a second front attachment 915, which may be removably coupled to the first front attachment 914 by e.g., fastening mechanism or an adhesive. The first front attachment 914 and the second front attachment may together be combined, and configured to be a snap-on-plate. The snap-on-plate may fit into the base 902 via a hole, using e.g., fastening mechanism, adhesive, and the like. The snap-on-plate may further include a bar 919.

The bar 919 may rotate in places and lifts up the at least one wheel 904 and at least one deflector 921 (as shown in, e.g., FIG. 4). A user may use their finger or a tool, as a level to pull up the bar 919, which will rotate the bar 919 and lift up the at least one wheel 904 and the at least one deflector 921.

Figure 12:
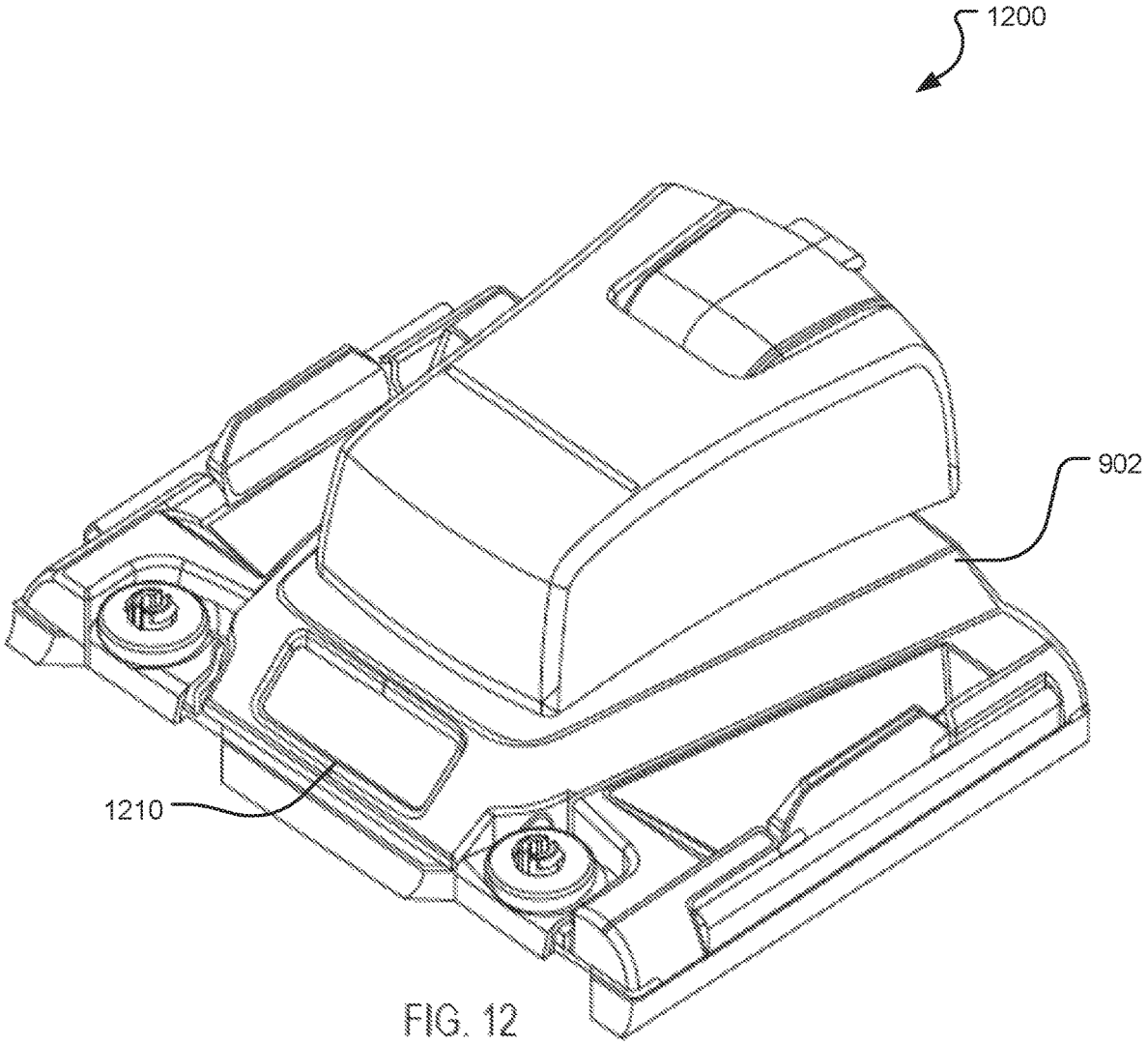
FIG. 12 shows a side perspective view of yet another example of an edging tool that is constructed in accordance with the present disclosure.
Figure 13:
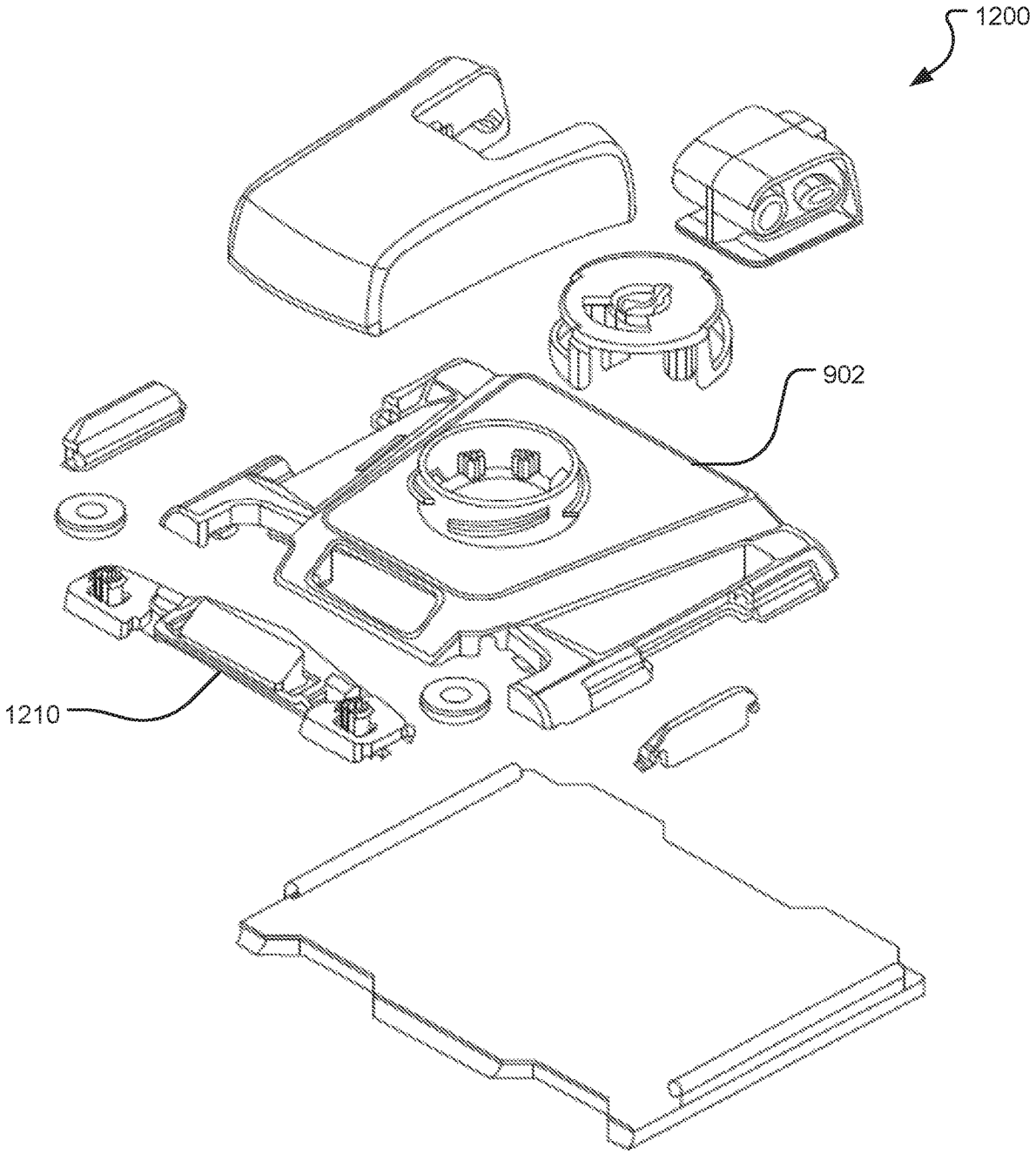
FIG. 13 shows an exploded view of an edging tool shown in FIG. 12.

In yet another embodiment of the present disclosure, the first and second front attachments may be provided as a singular snap-on-plate unit 1210 that is molded together (as shown in FIGS. 12-13). The snap-on-plate unit 1210 may be completely static and include a built in deflector and a wheel. The snap-on-plate unit 1210 may snap into the base 902 via e.g., a hole.

The painting pad 906 may be detachable from the base 902, and may be replaceable. The base 902 may further include a pad ejector 918 which may configured to remove the painting pad 906 from the base 902. The pad ejector 918 may flip down to eject the painting pad 906. The painting pad may include at least one side rod 922 which may fit into at least one side opening 924 of the base 902. After the at least one side rod 922 is fit into the at least one side opening 924, the pad ejector 918 may be attached onto the at least one side opening 924 in order to eject the painting pad 906 from the base 902. In a further embodiment of the present disclosure, the pad ejector 918 may be configured to removably attach the painting pad 906 onto the base 902.

In another embodiment of the present disclosure, the painting pad 906, the base 902, and the cover element 908 may be provided as a singular unit via e.g., molded production, and the like.

In yet another embodiment of the present disclosure, the base 902 may be configured to connect to a paint reservoir (not shown) so that paint may be transferred from the paint reservoir to the painting pad 906 through the base 902 (as shown in e.g., FIG. 7).

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications, or modifications of the disclosure.

What is claimed:

1. An edging tool for applying a liquid to a wall comprising:

a base having an adaptor extending from the base;

a painting pad that is adjacent and parallel to the base;

a cover element that is mounted on the base;

a base connector that engages threads of the adaptor of the base to secure the cover element to the base;

a paint ejector configured to remove the painting pad from the base; and a rotation stop configured to prevent the pad ejector from rotating beyond an angle that results in the pad ejector being trapped below the painting pad.

2. The edging tool of claim 1, further comprising a connector element that is configured to allow rotation between multiple positions as to allow the edging tool move in a flexible manner.

3. The edging tool of claim 1, further comprising a connector element that allows a pivoting motion in relation to the wall.

4. The edging tool of claim 1, further comprising at least one wheel attached along an edge of the base, wherein the base comprises at least one lobe, wherein the at least one lobe is configured to be located on each side of the base, and is further configured to connect with the at least one wheel.

5. The edging tool of claim 1, further comprising at least one wheel located near a front edge of the base, wherein the at least one wheel is configured to guide the edging tool along the wall.

6. The edging tool of claim 1, wherein the painting pad is configured to be placed on an underside of the base.

7. The edging tool of claim 1, wherein the painting pad comprises at least one hole on a bottom of the painting pad to allow the liquid through.

8. The edging tool of claim 1, wherein the base further comprises at least one built-in deflector, wherein the at least one built-in-deflector is configured to be angled away from the wall.

9. The edging tool of claim 8, wherein the at least one built-in-deflector is statically molded to the base.

10. The edging tool of claim 8, further comprising at least one wheel attached along an edge of the base, wherein the painting pad is configured to be notched around the at least one deflector and the at least one wheel in order to allow painting inside a corner area of the wall.

11. The edging tool of claim 1, wherein the base further comprises filaments, wherein the filaments with light pressure, assist the painting pad with painting.

12. The edging tool of claim 1, wherein the edging tool is configured to apply a liquid is selected from a group comprising:

a paint;

a lacquer;

a sealer;

an ink;

a varnish;

a stain; and a dye.

* * * * *